US006293459B1

(12) United States Patent
Burch, Jr.

(10) Patent No.: US 6,293,459 B1
(45) Date of Patent: Sep. 25, 2001

(54) CARTON VENTILATION SYSTEM

(75) Inventor: William B. Burch, Jr., Marietta, GA (US)

(73) Assignee: RTS Packaging, LLC, Norcross, GA (US)

( * ) Notice: Subject to any disclaimer, the term of this patent is extended or adjusted under 35 U.S.C. 154(b) by 0 days.

(21) Appl. No.: 09/440,816

(22) Filed: Nov. 16, 1999

(51) Int. Cl.[7] ..... B65D 5/49; B65D 5/495

(52) U.S. Cl. ..... 229/120.23; 229/120.29; 229/120.32; 229/120.35; 229/120.36

(58) Field of Search ..... 229/120.23, 120.24, 229/120.25, 120.26, 120.29, 120.32, 120.35, 120.36; 217/23, 30, 31, 32, 33

(56) References Cited

U.S. PATENT DOCUMENTS

| | | | | |
|---|---|---|---|---|
| 345,510 | | 7/1886 | Jenkins et al. . | |
| 692,618 | * | 2/1902 | Carr | 229/120.32 |
| 1,153,365 | | 9/1915 | Wheeler . | |
| 1,162,887 | * | 12/1915 | Streit | 229/120.32 |
| 1,808,531 | | 6/1931 | Coyle . | |
| 2,021,208 | | 11/1935 | Stouffer . | |
| 2,113,097 | | 4/1938 | Schaefer . | |
| 2,138,112 | | 11/1938 | Means et al. . | |
| 2,404,065 | | 7/1946 | Hill . | |
| 2,511,550 | | 6/1950 | Simms . | |
| 2,580,043 | | 12/1951 | Paige . | |
| 2,699,866 | | 1/1955 | Russell . | |
| 2,749,012 | | 6/1956 | Beach . | |
| 3,045,888 | * | 7/1962 | Forrer | 229/120.32 |
| 3,465,948 | | 9/1969 | Boyer . | |
| 3,682,154 | * | 8/1972 | Mollere | 229/120.32 |
| 3,756,496 | | 9/1973 | Oostdik . | |
| 3,986,656 | * | 10/1976 | November | 229/120.35 |
| 4,110,955 | | 9/1978 | Rambold . | |
| 4,219,146 | | 8/1980 | Skaggs et al. . | |
| 4,272,008 | * | 6/1981 | Wozniacki | 229/120.23 |
| 4,869,599 | | 9/1989 | Allen . | |
| 4,895,250 | | 1/1990 | Schifrin . | |
| 5,597,113 | | 1/1997 | Bradford . | |
| 5,868,252 | * | 2/1999 | Oliff | 229/120.32 |

FOREIGN PATENT DOCUMENTS

| | | | | |
|---|---|---|---|---|
| 464060 | * | 4/1937 | (GB) | 229/120.36 |
| 2228923 | * | 9/1990 | (GB) | 229/120.36 |

* cited by examiner

*Primary Examiner*—Gary E. Elkins
(74) *Attorney, Agent, or Firm*—Howell & Haferkamp, LC

(57) ABSTRACT

A partitioned container assembly for separating articles to be packaged in a container in a manner that facilitates ventilation of the compartments. The assembly includes one or more divider partitions configured to form an asymmetrical pattern of compartments and specially adapted separating sheets positioned between stacked divider partitions and aligned therewith to improve ventilation between layers of divider partitions without sacrificing functionality.

21 Claims, 2 Drawing Sheets

CARTON VENTILATION SYSTEM

BACKGROUND OF THE INVENTION (1) Field of the Invention

The present invention pertains to a partition assembly which defines a plurality of compartments for use in a container. More particularly, the present invention pertains to a partition assembly which separates articles packaged in containers in an asymmetrical manner that facilitates ventilation of the partitioned compartments.

(2) Description of the Related Art

Partition assemblies are commonly used in container packaging for separating articles packaged in the containers and preventing the articles from contacting one another when the articles are being shipped or stored. This is true for breakable articles, such as glassware and other similar articles, but is also true when packaging easily bruised food items such as fruits and vegetables.

A typical partitioned container assembly is comprised of a container, such as a cardboard or paperboard box, and one or more divider partitions. Additionally, the container assemblies often include a separating sheet between every two divider partitions when a stack of two or more divider partitions is used.

The divider partition is inserted into the container and defines a plurality of separate storage compartments along a length and width of the container interior, each compartment capable of receiving a separate article to be packaged within the container. A typical divider partition is comprised of a plurality of vertical panels of paperboard, cardboard, or other equivalent material arranged in a crisscrossing pattern and is usually formed by interlocking a plurality of rectangular panel blanks together. A first set of one or more panels each has a series of one or more slots extending downward, in parallel manner, from the top edge of each panel and terminating midway through the height of the panel. A second set of panels, each having similar slots extending upward from the bottom edge, are typically arranged perpendicular to the first set of panels and the slots of each set of panels cooperate by engaging with one another to form the divider partition. In order to reduce inadvertent disassembly, partition dividers may also incorporate tabs, folds, adhesives, or other means known in the industry to lock the panels to one another. By varying the number of first and second panels, and the number of slots in each panel, various configurations of divider partitions can be constructed.

Typically, divider partitions are designed such that, when inserted into a container, the first set of panels are positioned parallel to a sidewall of the container and the second set of panels are positioned parallel to an adjacent sidewall of the container. In such a configuration, a plurality of rows of compartments are formed, each row having an identical number of compartments therein. However, various prior art divider partitions have utilized panels arranged diagonally to the side walls of the container as shown, for example, in U.S. Pat. No. 4,219,146. Typically, a diagonally arranged divider partition forms rows of compartments parallel to a sidewall of the container that alternate with respect to the number of compartments per row. For example, a row of compartments adjacent and parallel to a container sidewall would have four compartments, then the next row would have three compartments, then the next row four, the next row three, and so on. Because alternating rows typically reduce the number of compartments formed within a given container as compared to divider partitions having panels parallel to the side walls of the container, the use of diagonally arranged divider partitions may be disadvantageous if no other benefit can be realized from their use. One such advantage of using a diagonally arranged divider partition is that, in many situations, two or more panels can be formed from a single panel blank by folding the blank along one or more vertical fold lines to create a separate panel on either side of the fold line. Thus, the number of blanks needed to create a given number of compartments is reduced compared to divider partitions that utilizes separate panel blanks for each panel. This can reduce the cost and logistics associated with the assembly of divider partitions.

Divider partitions are typically only slightly taller than the articles being packaged in the containers. When the container is substantially taller than a divider partition, container assemblies often include a stack of two or more divider partitions within the container. In such a situation, it is common to place a separating sheet between each two divider partitions to prevent each of the articles packaged in the compartments of a first partition divider from contacting or resting upon another article in a compartment formed by a second divider partition that is directly above or below the first. The separating sheet is generally a flat rectangular sheet constructed of the same material as the divider partition panels and has a width and length corresponding to the internal length and width of the container.

When the articles being packaged are easily spoiled food items such as fruits and vegetables, it is desirable to circulate chilled air, ripening agents, and insecticides throughout the produce in the containers. For this reason, prior art partition assemblies frequently provide means for ventilating one or more of the compartments such as providing slots, holes, or perforations throughout the container assembly. Despite such means, it remains difficult to achieve adequate ventilation throughout the compartments of partitioned container assemblies.

The present invention overcomes the problem of insufficient ventilation of prior art partitioned container assemblies by utilizing a divider partition that provides asymmetric positioning of the compartments in a manner that facilitates ventilation of the compartments. Additionally, a separating sheet, optimized to work in conjunction with the divider partitions, can be positioned between stacked layers of compartments to improve ventilation between layers of partitions over that provided by traditional prior art separating sheets.

SUMMARY OF THE INVENTION

Among the several objects of this invention may be noted the provision of an improved divider partition and separating sheet for use in a partitioned container assembly. In accordance with the partitioned container assembly of this invention, a divider partition has panels positioned diagonally to the sides of the container and defines one less compartments against a first side of the container than against an opposite, second side. A separating sheet may be placed on top of the divider partition to provide a surface upon which an additional divider partition may be placed. The separating sheet forms ventilation passages between two adjacent divider partitions at locations associated to the pattern of compartments formed by the divider partitions.

While the principle advantages and features of the present invention have been described above, a more complete and thorough understanding and appreciation for the invention may be attained by referring to the drawings and description of the preferred embodiment which follow.

BRIEF DESCRIPTION OF THE DRAWINGS

Reference characters in the written specification indicate corresponding parts throughout the several views of the drawings.

DETAILED DESCRIPTION OF THE PREFERRED EMBODIMENT

Figure 1:
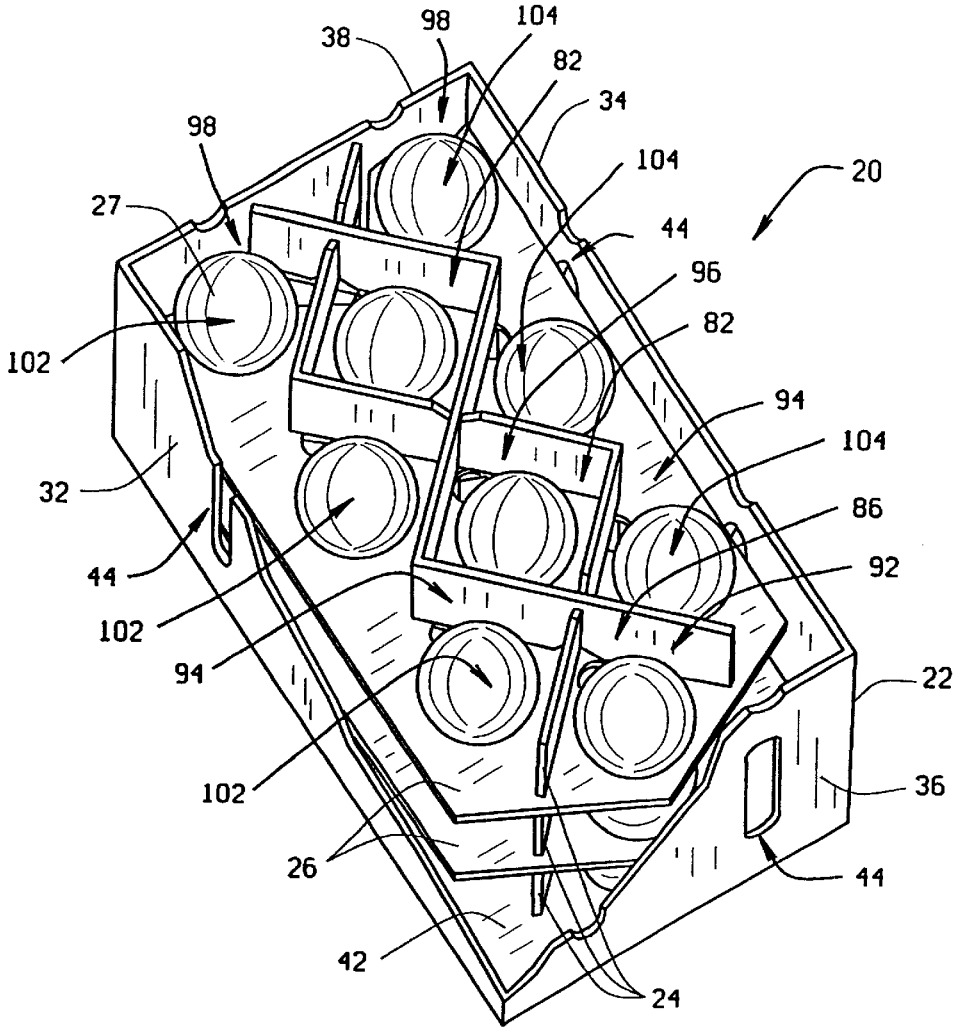
FIG. 1 is an isometric view of a partitioned container assembly constructed according to the principals of this invention with spherical items schematically representing produce packaged therein, the container being shown partly broken away.

The preferred embodiment of the partitioned container assembly of this invention is illustrated in FIG. 1 and can be used in conjunction with various articles shipped or stored in containers. FIG. 1 shows a partitioned container assembly 20 comprised of a container 22, one or more divider partitions 24, and a separator sheet 26 positioned between every two adjacent divider partitions 24. The container 22 is shown partially broken away and the articles 27 to be packaged therein are schematically represented as spheres. In the preferred embodiment, the container assembly is intending for use in packaging produce and the spheres in FIG. 1 represent produce.

The container 22 is a standard rectangular container such as a cardboard or paperboard box of the type commonly used in transporting fresh produce, as well as other items. By describing the container 22 as rectangular, it is also intended to include a square container. The container has first 32 and second 34 longitudinally extending sidewalls, first 36 and second 38 laterally extending sidewalls, and a bottom 42. The sidewalls and bottom are all connected together by any known method of box construction. In addition, the sidewalls of the container are provided with oblong, upwardly extending slots 44 to provide ventilation to the interior of the container. The container 22 shown in FIG. 1 is shown without a top closure. However, the container could be provided with any of the known type of closures for a box such as a removable top or flaps that are attached to the top edges of the sidewalls that can be folded over to close the interior of the container.

The container 22 shown in FIG. 1 contains three divider partitions 24 stacked on each other and separated by two separator sheets 26. Depending on the vertical height of the particular container employed, the container interior could contain only one divider partition 24 or any number of divider partitions.

Figure 2:
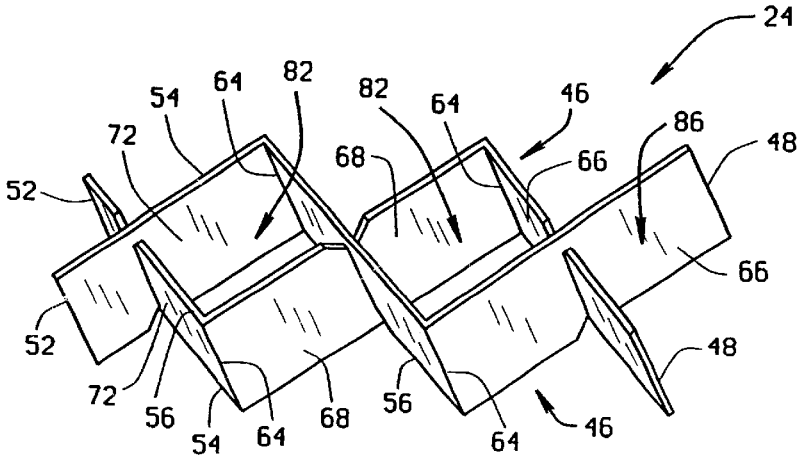
FIG. 2 is isometric view of a divider partition of the preferred embodiment.
Figure 3:
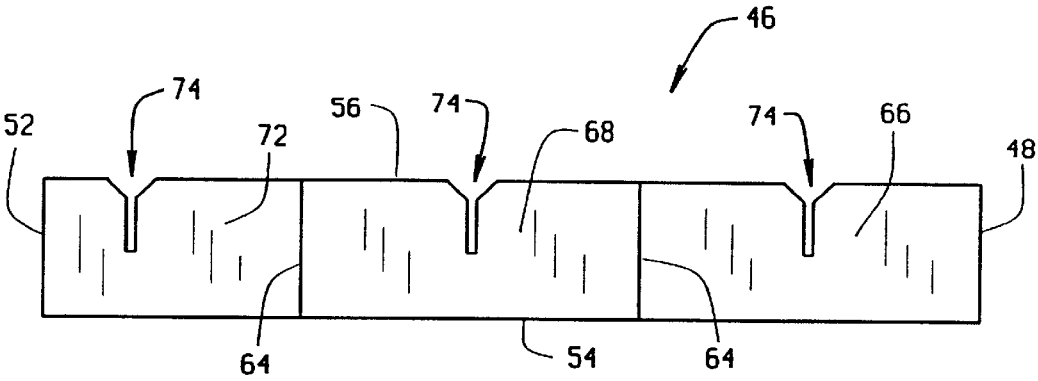
FIG. 3 is an elevation view of an unfolded panel blank used to form the divider partition.

The particular construction of the divider partition 24 of the invention is shown in FIG. 2. The divider partition 24 is constructed of two identical blanks 46 of the type shown in FIG. 3. Each blank 46 is formed from a rectangular strip of cardboard or paperboard material. The blank 46 has a longitudinal length between opposite first 48 and second 52 ends of the blank. Each blank 46 has a longitudinally extending bottom edge 54 and a longitudinally extending top edge 56 that extend between the two ends of the blank. A series of slots are cut into the blank 46 with the blank shown in FIG. 3 having three slots 58 cut into the top edge 56 of the blank. The slots 58 extend at least half way through the blank 46 between its top and bottom edges and have equal longitudinal spacings between each other. Folds 64 are formed in the blank 46 and are positioned midway between adjacent slots 58. The number of folds 64 and slots 58 made in the blank 46 shown in FIG. 3 determine the construction of the particular divider partition 24 shown in FIG. 2. Of course, if the divider partition 24 were to be longer, additional folds and slots would be needed. Furthermore, in forming the particular divider partition 24 of the invention, the folds 64 are longitudinally positioned on the blank 46 a greater distance from the first end 48 than from the second end 52 to form a pair of panels 66, 68 having equal longitudinal length dimensions and a third panel 72 that has a lesser longitudinal length dimension than the other two. This dimensioning of the blank 46 gives the diverter partition 24 its asymmetric configuration that is described infra.

In assembling the pair of blanks 46 together to construct the diverter partition 24 of FIG. 2, each blank 46 is first folded along its folds 64 to form a zigzag configuration. One of the blanks is then inverted and the two blanks are then assembled together as shown in FIG. 2 with their respective slots 58 interlocking. To further assist in the interlocking of the two blanks, each of the slots is provided with a chamfered opening 74 to assist in alignment of the slots of one blank with the slots of the other blank during assembly of the divider partition. Although all of the slots 58 of each blank 46 are shown cut into the same longitudinally extending edge of each blank, two slots could alternatively be cut into one edge of the blank and one slot into the opposite edge of the blank. Such an alternative configuration of the slots would require the blanks to be slightly twisted relative to each other when interlocking the slots during assembly of the divider partition yet could prevent inadvertent disassembly of the two blanks from the divider partition during use.

With the two blanks assembled forming the divider partition 24 shown in FIG. 2, the partition has two diamond-shaped or square shaped enclosed compartments 82. Due to the particular configuration of the blanks 46, both compartments 82 have sides of equal longitudinal length that are formed by the panels 66, 68, 72 of the blanks. At a first longitudinal end of the divider partition 24 shown to the right in FIG. 2, portions of the panels 66 adjacent the first ends 48 of the blanks 46 form a V-shaped compartment 86. The opposite ends 52 of the blanks 46 are also positioned in a V-shape at a second, longitudinally opposite end of the divider partition 24 shown to the left in FIG. 2. However, the V-shape formed at the second end of the divider partition 24 is smaller than the V-shaped compartment 86 formed at the first end due to the shortened lengths of the panels 72 adjacent the second ends 52 of the blanks 46. Thus, the particular configuration of the blanks 46 gives the divider partition 24 its asymmetric configuration shown in FIG. 2 where the right-hand end of the partition is not the same as the left-hand end of the partition 24. This particular configuration of the divider partition 24 also provides for improved ventilation around the partition when inserted in the container 22 as will be described.

When the divider partition 24 is assembled into the container 22, the panels 66, 68, 72 of each of the partition blanks 46 are positioned at diagonals relative to the longitudinally extending sidewalls 32, 34 and the laterally extending sidewalls 36, 38 of the container. This diagonal arrangement of the panels forms lateral rows of compartments across the container interior that alternate in the number of compartments per row. For example, in viewing FIG. 1, a first lateral row of compartments adjacent the first laterally extending sidewall 36 of the container 22 has only one compartment 92. The next adjacent lateral row of compartments has two compartments 94. The next adjacent lateral row of compartments has only one compartment 96, and so on. This continues longitudinally across the interior of the container 22 to the last lateral row of compartments that includes two compartments 98. Thus, due to the particular configuration of the divider partition 24, the lateral row of compartments adjacent the first laterally extending sidewall 36 of the container has a different number of compartments than the last lateral row of compartments adjacent the second laterally extending sidewall 38 of the container. Depending on the number of blanks employed in constructing each divider partition assembled into any particular horizontal plane in the container 22, the divider partitions will have alternating lateral rows of compartments in which the rows alternate in having an N number of compartments and an N+1 number of compartments. In the preferred embodiment of the invention shown in FIG. 1, N equals 1 so that the first lateral row of compartments has only one compartment 92. The next adjacent lateral row of compartments has two compartments 94, and so on. Also, in the preferred embodiment of the divider partition 24 shown in FIG. 1, the number of compartments 102 adjacent the first longitudinally extending sidewall 32 of the container is the same number of compartments 104 adjacent the second longitudinally extending sidewall 34 of the container.

An additional important feature of the divider partition 24 of the invention worth noting is that the panels of the blanks are dimensioned sufficiently large enough to separate the articles 27 between compartments, but the longitudinal dimensioning of the panels is such that the longitudinal length of the divider partition 24 is shorter than the longitudinal length of the container 27 and the lateral length of the divider partition 24 is also shorter than the lateral length of the container 22. This provides gaps between the divider partition 24 and the container sidewalls that serve as ventilation gaps or ventilation passages between compartments. The gaps or passages enable a free flow of air around the articles contained in the container 22 and the diverter partition 24.

Figure 4:
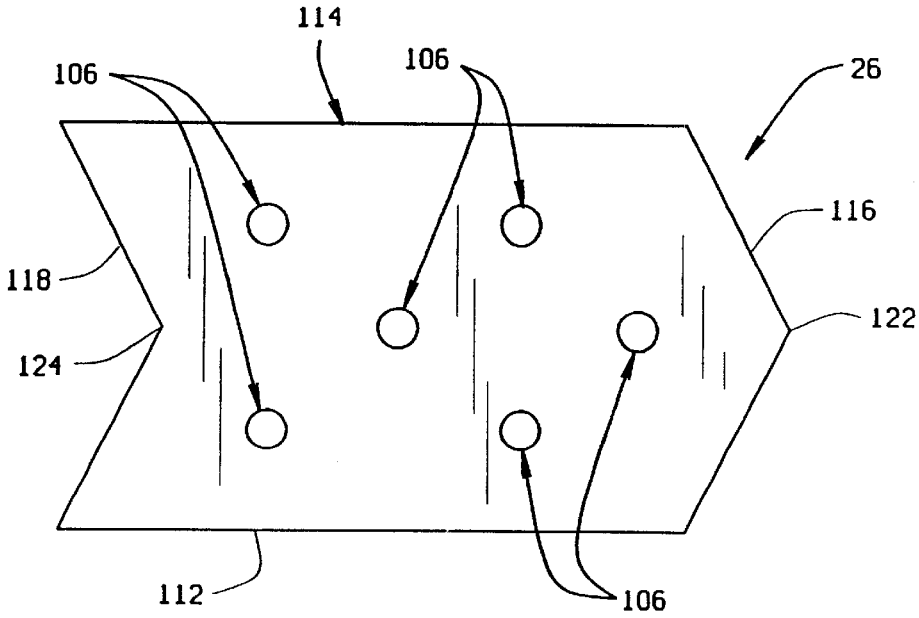
FIG. 4 is a plan view of a separating sheet used to practice the preferred embodiment of this invention.

When the partition container assembly 20 employs more than one divider partition 24, a separator sheet 26 is employed to separate any two diverter partitions 24 stacked in the container 22 to form layers of compartments within the container. The preferred embodiment of the separator sheet 26 is shown in FIG. 4. As with prior art separator sheets, additional ventilation passages or holes 106 are formed through the sheet. The sheet 26 is provided with laterally opposite, longitudinally extending first 112 and second 114 edges and longitudinally opposite, laterally extending first 116 and second 118 edges. Together, the longitudinal edges and lateral edges define the perimeter of the sheet 26. The first and second longitudinal edges 112, 114 are given lengths slightly shorter than the lengths of the opposite longitudinally extending sidewalls 32, 34 of the container 22. The laterally extending edges 116, 118 of the separator sheet have lengths that are slightly larger than the lengths of the laterally extending sidewalls 36, 38 of the container. The extended length of the first lateral edge 116 of the separator shown to the right in FIG. 4 is due to it having a generally convex configuration. This configuration is produced by the edge 116 being formed with two straight portions that meet at an apex 122 at the center of the separator sheet 26. In a like manner, the length of the second lateral edge 118 of the separator sheet is due to its having a generally concave configuration. This configuration is formed by the edge 118 having two straight portions that meet at a vertex 124.

The configuration of the perimeter of the separator sheet 26 creates vertical vent gaps or passages in the interior of the container 22 when the separator sheet is assembled into the container. Referring to FIG. 1, separator sheets 26 are shown positioned in the container 22 separating adjacent divider partitions 24 stacked in the container. As can be seen in FIG. 1, the separator sheets 26 are positioned in the container in a particular orientation relative to the divider partitions 24. The separator sheets are positioned so that their first lateral edges 116 are adjacent the first laterally extending sidewalls 36 of the container. This also positions the first lateral edge 116 of the separator sheet adjacent the first ends 48 of the blanks that make up the divider partitions 24. Thus, the extending portion of the separator sheet 26 provided by its convex configuration toward its apex 122 serves as a support for the article positioned in the first lateral compartment 92 formed by the V-shaped compartment 86 of the divider partitions 24. The manner in which the first lateral edge 116 tapers away from the apex 122 produces the ventilation gaps in the corners where the first laterally extending sidewall 36 of the container meets with the first and second longitudinally extending sidewalls 32, 34 of the container.

At the opposite end of the separator sheet 26, the points adjacent the opposite longitudinal edges 112, 114 of the sheet formed by the generally concave configuration of the second lateral edge 18 of the sheet are positioned beneath the compartments 98 in the last lateral row of compartments formed by the partition 24. These points serve as supports for articles positioned in the compartments 98. In addition, the concave configuration of the second lateral edge 118 formed by the vertex 124 of the edge produces a ventilation gap or passage that extends upwardly along the center of the second laterally extending sidewall 38 of the container 22. Each of the separator sheets 26 assembled into the container 22 separating divider partitions 24 stacked in the container are oriented in the same manner as shown in FIG. 1, thus providing ventilation passages that extend vertically upward through the container venting each of the layers of articles stacked in the container. In a like manner, each of the divider partitions 24 stacked in the container are oriented as shown in FIG. 1 where they function with the separator sheets 26 to provide support beneath the articles positioned in the container by the divider partitions 24.

The configuration of the separator sheet 26 creates ventilation passages on either side of the apex 122 and between the edges of the vertex 124, the passages being partially bound by the side of the container 22 when the sheet is placed horizontally therein. The apex 122 and the laterally opposite tips of the vertex 124 also act to limit horizontal translation of the separator sheet 26 relative to the container 22 by engaging the sides of container 22. In the preferred embodiment, the pointed apex 122 is complementary (i.e. like the opposite edges of two puzzle pieces that would fit together) to the chevron shaped vertex 124 which enables the separator sheets to be cut from a continuous strip of material reducing waste and cost during manufacture and minimizing spatial requirements for storing the separator sheets 26. However, it is not necessary that both ends of the separator sheet be complementary nor is it necessary that either end be pointed or chevron shaped.

Alternative embodiments of the partitioned container assembly that have more articles per row than in the preferred embodiment could utilize multi-pointed separating sheets in the same manner to provide increased ventilation over prior art assemblies.

While the present invention has been described by reference to specific embodiments, it should be understood that modifications and variations of the invention may be constructed without departing from the scope of the invention defined in the following claims.

What is claimed:

1. A divider partition for defining a plurality of compartments when inserted into a container having first and second longitudinally extending sidewalls and first and second laterally extending sidewalls, the sidewalls being connected to each other and to a bottom of the container, the divider partition comprising:

a first set of parallel panels;

a second set of parallel panels intersecting and extending across the first set of parallel panels in a manner so that the first and second sets of panels will both be diagonal relative to the longitudinally extending sidewalls and the laterally extending sidewalls of the container when the divider partition is inserted into the container, the first and second sets of parallel panels defining staggered lateral rows of compartments with an alternating number of compartments in adjacent rows, the number of compartments alternating between N number of compartments per row and N+1 number of compartments per row, and the first and second sets of parallel panels defining a row of N compartments adjacent the first laterally extending sidewall of the container and a row of N+1 compartments adjacent the second laterally extending sidewall of the container when the divider partition is inserted into the container.

2. The divider partition of claim 1, wherein:

the first and second sets of parallel panels define rows of a same number of compartments adjacent the first longitudinally extending sidewall and adjacent the second longitudinally extending sidewall of the container when the partition divider is inserted into the container.

3. The divider partition of claim 1, wherein:

the divider partition has a longitudinal length that is less than a longitudinal length of the container to leave ventilation gaps between longitudinally opposite ends of the divider partition and the first and second laterally extending sidewalls of the container when the divider partition is inserted into the container.

4. The divider partition of claim 3, wherein:

the divider partition has a lateral length that is less than a lateral length of the container to leave ventilation gaps between the laterally opposite ends of the divider partition and the first and second longitudinally extending sidewalls of the container when the divider partition is inserted into the container.

5. The divider partition of claim 1, wherein:

the N number of compartments is one compartment.

6. The divider partition of claim 1, wherein:

the first and second sets of parallel panels are formed by substantially identical first and second blanks that are interlocked with each other, each blank is rectangular and has a length with opposite top and bottom edges that extend along the length of the blank between opposite first and second ends of the blank, each blank has a plurality of slots that are equally spaced from each other along the length of the blank with a first slot adjacent the first end of the blank and a second slot adjacent the second end of the blank, the first slot being a greater distance from the first end of the blank than a distance of the second slot from the second end of the blank.

7. The divider partition of claim 6, wherein:

each blank has a plurality of folds that are positioned midway between adjacent slots of the plurality of slots.

8. A partitioned container assembly comprising:

a container having first and second longitudinally extending sidewalls and first and second laterally extending sidewalls, the sidewalls being connected to each other and to a bottom of the container;

first and second divider partitions, the first and second divider partitions being positioned within the container with the first divider partition being positioned above the second divider partition, each of the first and second divider partitions having panels that create a plurality of horizontally arranged compartments; and a sheet having first and second longitudinally extending edges and first and second laterally extending edges that together define a perimeter of the sheet, the first and second longitudinally extending edges have lengths that are shorter than lengths of the first and second longitudinally extending sidewalls of the container and the first and second laterally extending edges have lengths that are longer than lengths of the first and second laterally extending sidewalls of the container, the sheet being positioned in the container between the first and second divider partitions with the sheet longitudinally extending edges adjacent the longitudinally extending sidewalls of the container.

9. The assembly of claim 8, wherein:

the first and second longitudinally extending edges of the sheet are parallel to each other and to the first and second longitudinally extending sidewalls of the container and the first and second laterally extending edges are nonlinear and form ventilation gaps between the first and second laterally extending edges and the first and second laterally extending sidewalls of the container.

10. A separator sheet for separating partition dividers stacked in a container having first and second longitudinally extending sidewalls and first and second laterally extending sidewalls, the sidewalls being connected to each other and to a bottom of the container, the separator sheet comprising:

a sheet having first and second longitudinally extending edges and first and second laterally extending edges that together define a perimeter of the sheet, the first and second longitudinally extending edges have lengths that are shorter than lengths of the first and second longitudinally extending sidewalls of the container and the first and second laterally extending edges have lengths that are longer than lengths of the first and second laterally extending sidewalls of the container when the sheet is inserted into the container with the sheet longitudinally extending edges adjacent the longitudinally extending sidewalls of the container, the first and second laterally extending edges of the sheet have shapes that are complementary to each other.

11. A separator sheet for separating partition dividers stacked in a container having first and second longitudinally extending sidewalls and first and second laterally extending sidewalls, the sidewalls being connected to each other and to a bottom of the container, the separator sheet comprising:

a sheet having first and second longitudinally extending edges and first and second laterally extending edges that together define a perimeter of the sheet, the first and second longitudinally extending edges have lengths that are shorter than lengths of the first and second longitudinally extending sidewalls of the container and the first and second laterally extending edges have lengths that are longer than lengths of the first and second laterally extending sidewalls of the container when the sheet is inserted into the container with the sheet longitudinally extending edges adjacent the longitudinally extending sidewalls of the container, the first laterally extending edge has a convex configuration and the second laterally extending edge has a concave configuration.

12. A separator sheet for separating partition dividers stacked in a container having first and second longitudinally extending sidewalls and first and second laterally extending sidewalls, the sidewalls being connected to each other and to a bottom of the container, the separator sheet comprising:

a sheet having first and second longitudinally extending edges and first and second laterally extending edges that together define a perimeter of the sheet, the first and second longitudinally extending edges have lengths that are shorter than lengths of the first and second longitudinally extending sidewalls of the container and the first and second laterally extending edges have lengths that are longer than lengths of the first and second laterally extending sidewalls of the container when the sheet is inserted into the container with the sheet longitudinally extending edges adjacent the longitudinally extending sidewalls of the container, the first laterally extending edge is comprised of two straight edges that come to an apex and the second laterally extending edge is comprised of two straight edges that come to a vertex.

13. A partitioned container assembly comprising:

a container having first and second longitudinally extending sidewalls and first and second laterally extending sidewalls, the sidewalls being connected to each other in a rectangular configuration, and a bottom of the container connected to each of the sidewalls;

a divider partition in the container, the divider partition having a first set of parallel panels and a second set of parallel panels intersecting the first set of parallel panels in a manner that positions both the first and second sets of parallel panels at diagonals relative to the longitudinally extending sidewalls and the laterally extending sidewalls of the container, the first and second sets of parallel panels defining staggered lateral rows of compartments with an alternating number of compartments in adjacent rows, the number of compartments alternating between N number of compartments per row and N+1 number of compartments per row, the first and second sets of parallel panels defining a row of N compartments adjacent the first laterally extending sidewall of the container and a row of N+1 compartments adjacent the second laterally extending sidewall of the container; and a separator sheet in the container and on the divider partition, the sheet having first and second longitudinally extending edges and first and second laterally extending edges that together define a perimeter of the sheet, the first and second longitudinally extending edges are adjacent the container first and second longitudinally extending sidewalls and have lengths that are smaller than lengths of the longitudinally extending sidewalls and the first and second laterally extending edges are adjacent the container first and second laterally extending sidewalls and have lengths that are larger than lengths of the laterally extending sidewalls.

14. The partitioned container assembly of claim 13, wherein:

the first and second sets of parallel panels define rows of a same number of compartments adjacent the first longitudinally extending sidewall and adjacent the second longitudinally extending sidewall of the container when the partition divider is inserted into the container.

15. The partitioned container assembly of claim 13, wherein:

the divider partition has a longitudinal length that is less than a longitudinal length of the container to leave ventilation gaps between longitudinally opposite ends of the divider partition and the first and second laterally extending sidewalls of the container.

16. The partitioned container assembly of claim 15, wherein:

the divider partition has a lateral length that is less than a lateral length of the container to leave ventilation gaps between the laterally opposite ends of the divider partition and the first and second longitudinally extending sidewalls of the container.

17. The partitioned container of claim 13, wherein:

the first and second sets of parallel panels are formed by substantially identical first and second blanks that are interlocked with each other, each blank is rectangular and has a length with opposite top and bottom edges that extend along the length of the blank between opposite first and second ends of the blank, each blank has a plurality of slots that are equally spaced from each other along the length of the blank with a first slot adjacent the first end of the blank and a second slot adjacent the second end of the blank, the first slot being a greater distance from the first end of the blank than a distance of the second slot from the second end of the blank.

18. The partitioned container assembly of claim 17, wherein:

each blank has a plurality of folds that are positioned midway between adjacent slots of the plurality of slots.

19. The partitioned container assembly of claim 13, wherein:

the first and second longitudinally extending edges of the separator sheet are parallel to each other and to the first and second longitudinally extending sidewalls of the container and the first and second laterally extending edges of the separator sheet are nonlinear and form ventilation gaps between the first and second laterally extending edges and the first and second laterally extending sidewalls of the container.

20. The partitioned container assembly of claim 13, wherein:

the first laterally extending edge has a convex configuration and the second laterally extending edge has a concave configuration.

21. The partitioned container assembly of claim 13, wherein:

the first laterally extending edge is comprised of two straight edges that come to an apex and the second laterally extending edge is comprised of two straight edges that come to a vertex.

* * * * *